US006533211B2

(12) United States Patent
Kargel et al.

(10) Patent No.: US 6,533,211 B2
(45) Date of Patent: Mar. 18, 2003

(54) METHOD OF OPERATING A TEXTILE MACHINE FOR PRODUCING CHEESES

(75) Inventors: Heribert Kargel, Viersen (DE); Hans-Günter Wedershoven, Nettetal (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/844,694

(22) Filed: Apr. 27, 2001

(65) Prior Publication Data

US 2002/0023982 A1 Feb. 28, 2002

(30) Foreign Application Priority Data

Apr. 27, 2000 (DE) ..... 100 20 665

(51) Int. Cl.[7] ..... B65H 54/22; B65H 63/06; D01H 13/26

(52) U.S. Cl. ..... 242/475.5; 242/485.4; 242/487.3; 57/264

(58) Field of Search ..... 242/475.4, 475.5, 242/485.4, 485, 487.3; 57/22, 23, 264

(56) References Cited

U.S. PATENT DOCUMENTS

| | | | | | |
|---|---|---|---|---|---|
| 3,294,326 | A | * | 12/1966 | Raasch | 242/475.5 |
| 4,804,151 | A | * | 2/1989 | Kathke | 242/475.4 |
| 4,854,515 | A | * | 8/1989 | Tone | 242/487.3 X |
| 5,188,304 | A | * | 2/1993 | Colli et al. | 242/475.5 X |
| 5,531,391 | A | * | 7/1996 | Yamamoto | 242/485.4 X |
| 5,853,137 | A | * | 12/1998 | Straaten et al. | 242/473.6 |
| 5,862,660 | A | * | 1/1999 | Haasen et al. | 57/22 |
| 5,950,957 | A | * | 9/1999 | Stiller | 242/475.5 |
| 6,039,281 | A | * | 3/2000 | Badiali et al. | 242/475.5 |

FOREIGN PATENT DOCUMENTS

| | | |
|---|---|---|
| DE | OS 26 02 235 | 8/1977 |
| DE | AS 26 53 233 | 12/1977 |
| DE | 32 40 486 A1 | 6/1983 |
| DE | 34 38 962 A1 | 4/1986 |
| DE | 37 16 473 A1 | 11/1988 |
| DE | 43 36 312 A1 | 4/1995 |
| DE | 196 40 184 A1 | 4/1998 |
| EP | 0 699 615 A1 | 3/1996 |
| EP | 0 628 509 B1 | 10/1996 |

OTHER PUBLICATIONS

Melliand Textilberichte Jan. 1988, pp. 16 and 17.
German Search Report.

* cited by examiner

*Primary Examiner*—Kathy Matecki
*Assistant Examiner*—Minh-Chau Pham
(74) *Attorney, Agent, or Firm*—Kennedy Covington Lobdell & Hickman, LLP

(57) ABSTRACT

A method of operating a textile machine for producing cheeses, at whose workstations (1) yarn (2) is unwound from supply bobbins (3), checked, cleaned of yarn defects and wound onto larger-volume cheeses (4) during which the yarn defects occurring the winding process in a given yarn length are registered. When a predetermined number of yarn joinders is exceeded within a predetermined reference yarn length, the winding process is stopped and the yarn length with the excessive number of joinders, already wound onto the cheese, is removed from the cheese (4).

5 Claims, 2 Drawing Sheets

METHOD OF OPERATING A TEXTILE MACHINE FOR PRODUCING CHEESES

CROSS REFERENCE TO RELATED APPLICATIONS

This application claims the benefit of German Application DE P 10020665.4 filed Apr. 27, 2000, herein incorporated by reference.

BACKGROUND OF THE INVENTION

The present invention relates to a method of operating a textile machine having plural workstations at each of which a yarn is unwound from supply bobbins, checked, cleaned of yarn defects, especially by a splicing or other yarn joining procedure, and then rewound into larger-volume cheeses.

As is known, yarn produced on a textile machine at the outset of the overall yarn production process, preferably a ring spinning machine, is wound onto relatively small-volume spinning cops. Thus, to prepare the yarn for use in subsequent machinery and operations, the yarn is rewound onto considerably larger package carriers, typically so-called cheeses. During this rewinding process, the yarn is constantly checked for any yarn defects, e.g., by a yarn cleaner or a slub catcher, as is explained in detail, e.g., in German Patent Publication DE 196 40 184 A1. Detected yarn defects are immediately removed.

More specifically, when the yarn cleaner discovers a yarn defect, a controlled yarn cut takes place immediately by means of a yarn separating device arranged in the area of the yarn cleaner. The lower yarn length leading from the spinning cop thereby produced is fixed in a yarn tensioner and held in a position ready for a subsequent yarn joining procedure while the upper yarn length trailing from the cheese and containing the yarn defect, is initially wound onto the cheese. The cheese is lifted off of its associated drive drum at the same time as the cutting of the yarn and is braked to a standstill by an appropriate bobbin brake. The upper yarn length wound onto the surface of the cheese is aspirated by a suction nozzle. In particular, the mouth of the suction nozzle is positioned in the area of the cheese surface and the cheese is slowly rotated in a reverse direction to unwind its yarn. After the defective yarn length has been removed, the upper yarn is re-joined to the lower yarn in a splicing device into which the lower yarn had previously been inserted by a gripper tube.

Even though the yarn splice produced thereby represents a joining that is nearly uniform with the yarn and is hardly visible in a subsequent fabric, cheeses in which a predetermined number of such yarn splices is exceeded are often considered as inferior or lower-grade cheeses by subsequent processing operations, e.g., weaving mills, and the production of such cheeses should therefore be avoided, if possible.

European Patent Document EP 0 628 509 B1 teaches a bobbin winding machine in which the traveling yarn is continuously checked, as is customary, by a yarn cleaner for yarn defects. In addition, the yarn length drawn off from the spinning cop is continuously detected in this known device. If the number of the detected yarn defects relative to a certain amount of the yarn to be rewound exceeds an adjustable number, the winding process is stopped and the yarn is cut. A predeterminable amount of yarn is subsequently drawn off from the presented spinning cop and removed by a special suction removal device. In other words, this known method is based upon the fact that only a relatively limited, defective amount of yarn is present on a spinning cop which amount is removed by the suction removal action described above. The lower yarn leading from the spinning cop is subsequently re-joined, as is customary, in an appropriate splicing device to the upper yarn retrieved from the cheese and the rewinding process continued.

However, this known method has the serious disadvantage that spinning cops also often have defective yarn material throughout, so that defective yarn continues to be wound on even after the suction removal action. In addition, this known method has the disadvantage that the yarn amount that has been cleaned out but still has disproportionately many yarn joinders remains in every instance on the cheese.

SUMMARY OF THE INVENTION

In view of the above-described state of the art, it is an object of the present invention to develop a method that assures than only cheeses are manufactured in which the number of yarn joinders per associated reference yarn length does not exceed an adjustable number.

The invention addresses this objective by providing an improved method of operating a textile machine of the type having plural workstations at each of which a yarn is unwound from supply bobbins, checked, cleaned of yarn defects and then rewound into larger-volume cheeses. More specifically, the present method basically comprises the steps of registering yarn joinders performed during the winding process and, when a predetermined number of yarn joinders are exceeded over a predetermined reference yarn length, stopping the winding process and unwinding and removing the reference yarn length having the excessive number of yarn joinders from the cheese.

The method in accordance with the invention has the particular advantage of constantly assuring that the cheeses produced have only a certain, adjustable, tolerable number of yarn joinders. That is, the method of the invention assures that the cheeses always have a certain minimum quality level, at least as concerns the number of their yarn joinders.

A preferred embodiment provides that the yarn length wound onto the cheese as well as the number of yarn joining procedures that occurred are monitored by the workstation computer of the particular workstation. Thus, the workstation computer, that is already present at each workstation m any case, is reprogrammed by software so that it can assume additional functions.

According to another aspect of the present invention, the number of joining procedures acceptable in a certain yarn length and the particular reference yarn length can be adjusted in a central control unit of the textile machine. Since this central control unit communicates with all workstation computers, it is possible to change and/or correct the number of tolerable joining procedures as well as the associated reference yarn length in a simple and rapid manner, e.g., by downloading the particular adjustment data.

However, it is basically also possible to input the particular adjustment data directly into the individual workstation computers. Such a method can be suitable, for example, if several batches with differing quality requirements for the cheeses are processed simultaneously on a bobbin winding machine.

A further embodiment of the invention advantageously provides that the reference yarn length recognized as defective is removed, if necessary, by the suction nozzle of the particular workstation. In this instance, existing hardware is also used almost without further expense for this additional purpose.

Further details of the invention can be understood from an exemplary embodiment described in the following disclosure with reference to the accompanying drawings.

DETAILED DESCRIPTION OF THE PREFERRED EMBODIMENT

Figure 1:
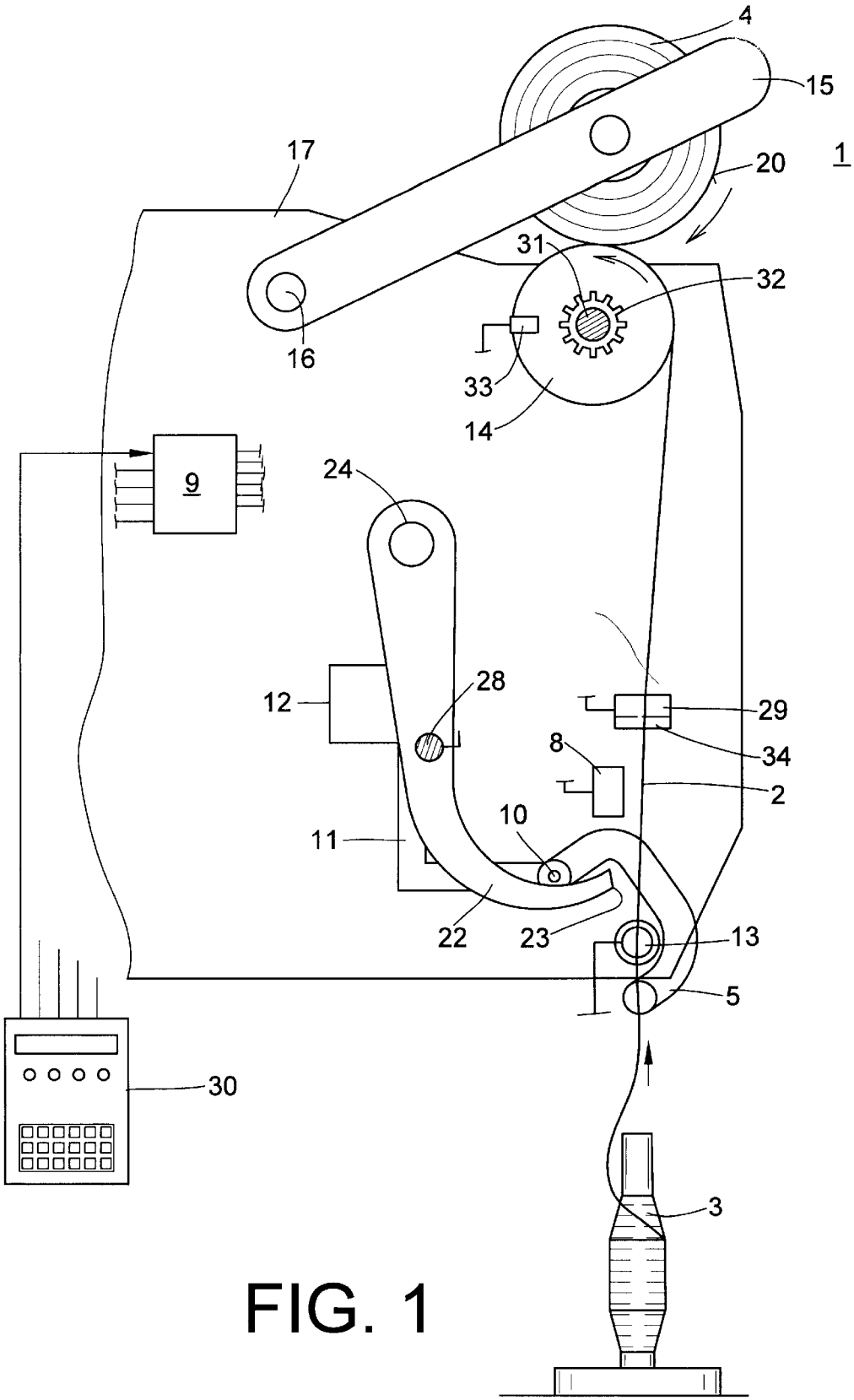
FIG. 1 is a schematic lateral view of a workstation of a textile machine for producing cheeses that is suitable for implementing the method of the present invention during the regular winding operation.

Workstation 1 of a so-called automatic cheese winder is schematically shown in FIG. 1. Such automatic cheese winders generally have a plurality of serially arranged workstations 1. Unwinding bobbins 3, typically in the form of spinning cops, are rewound into larger-volume bobbins 4, commonly referred to as cheeses.

During the rewinding process, as is indicated in FIG. 1, yarn 2 drawn off from spinning cop 3 is continuously tested for any yarn defects by yarn cleaner 29.

Such workstations 1 of an automatic cheese winder have different sensors and other components that act on the yarn to make an orderly rewinding process possible, as is known and therefore only schematically indicated in the drawings.

Each workstation 1 comprises, e.g., a gripper tube 5 for receiving a lower length of yarn 6 leading from the spinning cop 3 (see FIG. 2), e.g., in the event of a controlled yarn cut by yarn cutting device 34 in which case the lower yarn 6 is held fixed in yarn tensioner 13. Moreover, in order to reestablish a yarn connection between this lower yarn 6 and an upper yarn length 27 extending from the cheese, yarn splicing device 8 is provided at a location arranged somewhat outside of the regular course of the yarn travel.

In addition, yarn 2 travels on its path to cheese 4, as already indicated above, through yarn cleaner 29 and yarn cutting device 34.

Figure 2:
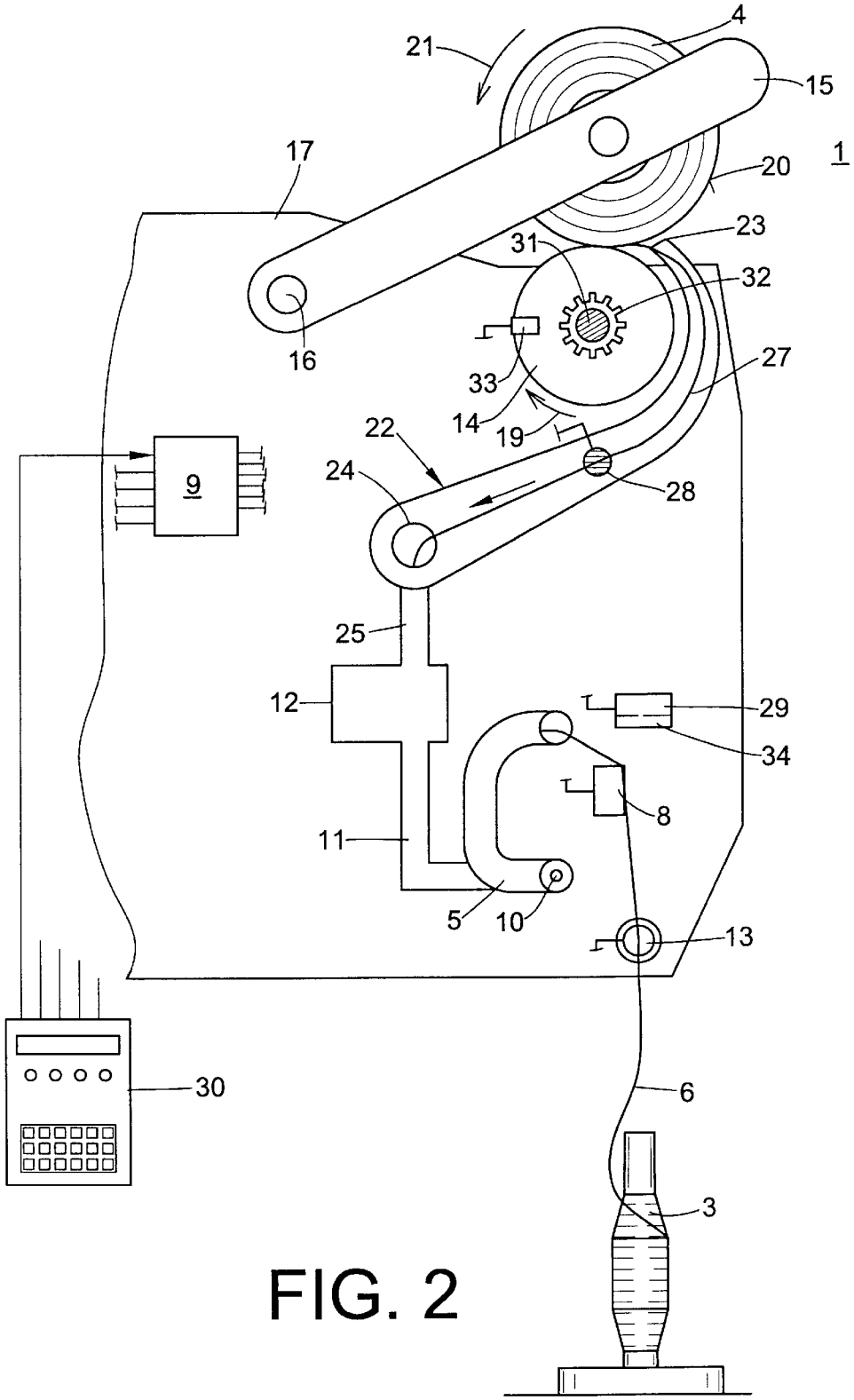
FIG. 2 is another schematic lateral view of the workstation according to FIG. 1 while the defective yarn length is being removed by the suction nozzle of the workstation.

The winding device of such a workstation 1 basically comprises pivotably mounted creel 15 for holding cheese 4 in a rotatable manner and yarn guide drum 14 for driving cheese 4 by frictional engagement. In addition, yarn guide drum 14 also assures that yarn 2 is wound in crossing layers. As is indicated in FIGS. 1 and 2, creel 15 is fixed for a limited range of movement via pivot shaft 16 on workstation housing 17. Yarn guide drum 14 is loaded via a reversible drive with controllable speed (not shown) like that known, e.g., from German Patent Publication DE 43 36 312 A1. Moreover, sensor device 32, 33 is arranged in the area of yarn guide drum 14 to make possible the measurement of the yarn length wound onto the cheese.

More specifically, the sensor device preferably comprises a cog-like magnet wheel 32 fastened to rotating bearing shaft 31 of yarn guide drum 14. The magnet wheel comprises a certain number of magnetic poles uniformly distributed over its circumference whose passage is detected by stationary sensor 33 and transmitted via an appropriate signal lead to workstation- and workstation computer 9. The number of detected pulses is counted in workstation computer 9 and the length of wound yarn 2 calculated therefrom.

Instead of a magnet wheel sensor device, other sensor devices can of course also be used to detect the length of the wound yarn.

As is also apparent from FIG. 1, each workstation 1 comprises, in addition to the initially mentioned gripper tube 5 movable about pivot shaft 10, a suction nozzle 22 whose mouth 23 can pivot, as indicated in FIG. 2, into the vicinity of the circumferential surface 20 of cheese 4. Suction nozzle 22 is supported in such a manner that it can pivot to a limited degree about pivot shaft 24 and is connected via vacuum line 25 to suction conduit 12 that preferably extends the full length of the machine. Moreover, suction nozzle 22 comprises internal sensor device 28 for detecting the presence of the upper yarn 27 when aspirated into the suction nozzle.

As FIGS. 1 and 2 also show, gripper tube 5 is also connected via appropriate vacuum line 11 to suction conduit 12.

The method of the present invention may thus be understood. The normal ongoing winding process basically involves withdrawing the yarn 2 from supply bobbin 3 and winding the yarn 2 onto large-volume cheese 4 rotatably supported between the arms of creel 15. Cheese 4 is driven by frictional engagement by yarn guide drum 14 that also assures a prescribed, crossing placement of yarn 2.

Yarn 2 passes through yarn tensioner 13, among other components, on its path to cheese 4, which tensioner assures a defined winding tension during the winding process, as is known. In addition, yarn 2 passes yarn cleaner 29 and yarn separating device 34, both of which are connected via appropriate signaling and control leads to workstation computer 9 of the particular workstation. The yarn length wound during the winding process is detected thereby by sensor device 32, 33 that is also connected to workstation computer 9.

Yarn cleaner 29 is typically integrated into a cleaner measuring head and permanently scans the traveling yarn 2. As soon as yarn cleaner 29 detects a yarn defect, e.g., a thick area (e.g., a stub) or a thin area, yarn separating device 34 also located inside the cleaner measuring head is actuated to thereupon cut yarn 2.

At the same time, workstation computer 9 also assures that cheese 4 is raised from yarn guide drum 14 and that cheese 4 as well as yarn guide drum 14 are braked to a standstill.

Since lower yarn 6 is generally fixed in yarn tensioner 13 during such a controlled yarn cut, lower yarn 6 can be grasped and placed relatively easily by gripper tube 5 into splicing device 8. Gripper tube 5 is thereby pivoted from the yarn receiving position indicated in FIG. 1 into the yarn insertion position shown in FIG. 2.

The upper length yarn 27 produced by the cut, which upper yarn contains the yarn defect, is wound onto surface 20 of cheese 4 after the yarn cut. This upper yarn length 27 is aspirated into suction nozzle 22 upon pivoting of its mouth into the vicinity of surface 20 of cheese 4. Moreover, as is customary, yarn guide drum 14 is rotated backwards in the direction of arrow 19 to rotate cheese 4 therewith in the yarn unwinding direction 21. Ordinarily, upon a break in the yarn or a controlled cut when a yarn defect is detected, only enough yarn length is aspirated by suction nozzle 22 to insure that the yarn defect is reliably removed. Suction nozzle 22 subsequently also places the cleaned upper yarn 27 into splicing device 8, where both yarn ends are spliced after an appropriate preparation of the yarn ends. Splicing device 8 is also connected to workstation computer 9 via appropriate control leads and is controlled by the latter in a defined manner.

Thus, the yarn length wound between the occurrence of two successive yarn joining procedures and also the number of yarn joining procedures are stored in workstation computer 9 of the particular workstation.

The number of yarn joining procedures that is tolerable within a certain yarn length wound onto cheese 4 should correspond to a certain quality standard which can be set via central control unit 30 of the textile machine that is connected to individual workstation computers 9 of the workstations.

Thus, when workstation computer 9 determines that the number of permissible yarn joining procedures has been exceeded within the preset reference yarn length, workstation computer 9 automatically assures that the already wound reference yarn length is removed completely from cheese 4.

To this end, a controlled yarn cut is actuated in similar manner to a controlled yarn cut as described above for removing a yarn defect and the suction nozzle 22 is then pivoted onto surface 20 of cheese 4 while the cheese is reversed by yarn guide drum 14 in the unwinding direction 21. As soon as sensor device 28 arranged inside suction nozzle 22 detects that a yarn end has been grasped and is present, i.e., the upper yarn 27 which has the excessive number of yarn joinders, the reference yarn length is removed by suction nozzle 22 and disposed of.

Sensor device 32, 33 and workstation computer 9 monitor the length of the upper yarn withdrawn into the suction nozzle 22 thereby to insure that at least a length of yarn corresponding to the set reference yarn length is unwound and removed from cheese 4.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of operating a work station of a textile machine in which a yarn is unwound at the work station from a supply bobbin, checked, cleaned of yarn defects and then rewound into a larger-volume cheese, the method comprising the steps of registering yarn joinders performed during the winding process and, when a predetermined plurality of yarn joinders are exceeded over a predetermined reference yarn length, stopping the winding process and unwinding and removing from the cheese the reference yarn length having the excessive number of yarn joinders.

2. The method according to claim 1, characterized further by monitoring at each respective workstation the number of yarn joinders and the yarn length wound onto the cheese by a workstation computer.

3. The method according to claim 1, characterized further by adjusting the predetermined number of yarn joinders and the predetermined reference yarn length via a central control unit of the textile machine.

4. The method according to claim 1, characterized further by adjusting the predetermined number of yarn joinders and the predetermined reference yarn length via a winding-head computer of a respective workstation.

5. The method according to claim 1, characterized in that removing of the reference yarn length having the excessive number of yarn joinders comprises aspirating the reference yarn length by a suction nozzle associated with the workstation including pivoting of an intake suction opening of the nozzle into the vicinity of the cheese in order to receive the reference yarn length.

* * * * *